United States Patent [19]

Walston

[11] 4,304,431

[45] Dec. 8, 1981

[54] HANDLING/LIFTER DEVICE FOR A CONCRETE SLAB OR THE LIKE

[76] Inventor: Everett V. Walston, 7629 Kimberly Dr., Indianapolis, Ind. 46256

[21] Appl. No.: 133,503

[22] Filed: Mar. 24, 1980

[51] Int. Cl.[3] ..... B66C 1/66

[52] U.S. Cl. ..... 294/89; 52/125

[58] Field of Search ..... 294/89, 91, 99 R, 78 R, 294/79; 52/125, 707

[56] References Cited

U.S. PATENT DOCUMENTS

| | | | |
|---|---|---|---|
| 3,187,694 | 6/1965 | Crookston et al. | 52/125 |
| 3,916,590 | 11/1975 | Miller | 52/125 |
| 4,179,151 | 12/1979 | Tye | 294/89 |

FOREIGN PATENT DOCUMENTS

| | | | |
|---|---|---|---|
| 3561 | 2/1979 | European Pat. Off. | 294/89 |

*Primary Examiner*—James B. Marbert

*Attorney, Agent, or Firm*—Robert A. Spray

[57] ABSTRACT

A handling/lifter device for a bulky mass or slab of associated materials such as concrete or the like. A housing body has a large hollow chamber, below which arms extend outwardly to retain or lock the device into the mass or slab; and a flexible cable, which is secured to the assembly of housing and arms, provides a graspable component which is stuffed into the housing's chamber but is withdrawable to provide a graspable loop when desired for a handling or lifting procedure.

8 Claims, 6 Drawing Figures

HANDLING/LIFTER DEVICE FOR A CONCRETE SLAB OR THE LIKE

The present invention relates to a handling/lifter device for a bulky mass or slab of associated material, such as particularly concrete or the like whose portions are relatively movable or "wet" during an initial stage but then become fixed into a rigid and bulky mass or slab in a subsequent or "set-up" or "hardening" stage during which the mass or slab of material is to be manipulated by some one or more lifting or handling procedures.

Such slabs are very heavy and bulky; and they often need to be handled several times, e.g., in stacking or storing in their manufacturing site, loading onto a truck, unloading, stacking at the site of construction, then raising into desired place in the construction procedure. Repetitions of certain of these tasks is often necessary, due to problems of storage, construction, etc., and thus the overall handling problems are quite substantial.

Accordingly the concepts provide an effective and efficient handling/lifting device which is conveniently embedded into the slab during its forming operation, which is of economical construction, effective of use, and easy to use.

The concepts further provide that it does not obtrusively extend above the slab surface where it would interfere with stacking of several slabs.

Further the concepts provide such a device which can be rapidly changed from a retracted condition, where it does not interfere with stacking, to a handling position in which it provides an accessible graspable portion well above the surface of the slab.

More particularly, the concepts provide a handling-/lifting device, having a housing and arms which lock the device into the concrete slab; but, in contrast to relatively expensive and time-consuming graspable hardware components of the prior art, provides a flexible cable means for the graspable component. The cable is retained, in its retracted position, stuffed into an open chamber of the housing; and the cable is merely pulled out of the chamber to provide a graspable loop when needed for a handling or lifting procedure. The flexibility of the cable also provides that it usually need not be restuffed into the housing chamber during any subsequent stacking procedure; although it is rapidly stuffable back thereinto for a permanent out-of-the-way position after all handling or lifting steps have been accomplished, and with negligible cost of future loss of the cable.

The integral or self-contained nature of the cable, of either an out-in-the-span embodiment or an along-the-edge embodiment, not only provides advantageously an economical graspable component, which is rapidly changed from retracted to graspable condition, and even in extended graspable condition is less bothersome to stacking than are prior art devices, but it avoids the need for either the slab manufacturer or the installation company to provide the relatively expensive graspable hardward components of prior art lifters.

This avoidance of the need for separate (prior art) graspable components, considering their relative expense, is particularly beneficial and economical; for there are many required at any job site, and unfortunately the separate and relatively expensive ones of prior art devices seem to get lost or perhaps even stolen.

Further, the integralness of the cable assures the immediate presence and availability of a graspable component; and, in contrast, even a few minutes' required search for a separate or separable graspable component of prior art lifters is quite costly in terms of lost labor time.

Further, the prior art's screw-type graspable component have other inherent disadvantages in comparison to the flexible, economical, and integrally self-contained cables of the present invention.

That is, the prior art's screw-type graspable components had disadvantages, in comparison to the present invention, which may be summarized as follows:

a. Labor time longer and thus more costly, in changing from retracted to graspable position, and vice versa;

b. obtrusiveness in their erect graspable position, bothering stacking;

c. inherently more expensive, due to screw threads, and to the fact that a graspable hook or abutment, extending perpendicular to the axis of the screw threads, must be provided;

d. the higher unit cost caused much higher overall cost, for any job may require many of such inserts, and even a single panel of slab may require several;

e. the separate ones of the prior art are easily stolen or lost;

f. if supplied by the manufacturer of the slabs, he might have trouble getting them returned; and an installer or construction project would dislike having to keep an inventory of such expensive, numerous, and easily lost components;

g. the present invention's ease and labor-saving rapidity of changing from graspable erect condition to retracted condition is particularly important considering the number of times each individual slab will or might be handled.

Prior art, discovered in a search after this invention was conceived is represented by the U.S. Pat. Nos. 3,124,385 (H. P. Neptune, 1964) and 3,420,014 (Courtois et al., 1969).

Neptune does not have any chamber large enough to stuff a cable, and it is of a nature different than the present invention. That is, the units are made to have a hollow core, but without any cable being connected thereto; then, after the concrete sets up, a complex "pick-up assembly" is inserted into the core, a concept quite different from the economical yet self-contained device of the present invention.

The Courtois device also uses a cable; but, similar to Neptune's, it uses removable posts which are removed after the concrete sets up to leave holes into which complex "pick-up units" are then connected.

Commercially-available concrete anchors are represented by those of Superior Concrete Accessories, Inc. However, these are relatively expensive devices, as shown in that company's "Superior Tilt-Up Construction Handbook" (Handbook TU-8, copyright 1977) and its "Superior Precast Concrete Handbook" (Handbook PR-4, copyright 1978) requiring such things as a forged lifting plate, a heavy forged bail and other components of a complex "lifting hardware unit."

In summary of the prior art, it has the several disadvantages outlined above; and from a standpoint of basic concept, none has a self-contained cable permanently affixed to the insert, with a loop-providing portion stuffed into an open core of the insert device, with other co-operating concepts herein set forth.

The above description has been of introductory and thus somewhat generalized nature. More particular details, concepts, features, and components are more fully set forth in the following more-detailed description of illustrative embodiments, reference being had to the accompanyng somewhat schematic drawings, in which:

FIG. 5 is a pictorial view of a handling/lifter device whose supporting arm structure is of modified form for use when the device is to be used a lifting means adjacent the edge of a concrete slab or the like.

Figure 1:
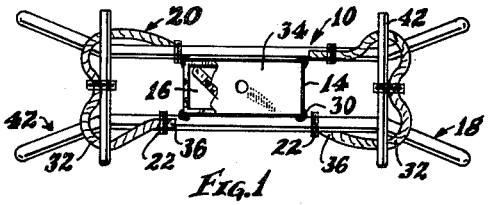
FIG. 1 is a top or plan view of a handling/lifter device, as for a concrete slab, with portions of a cap broken away to illustrate interior details, the device having a form of arm structure for a device to be used out in the span of a concrete slab in contrast to adjacent an edge thereof.
Figure 4:
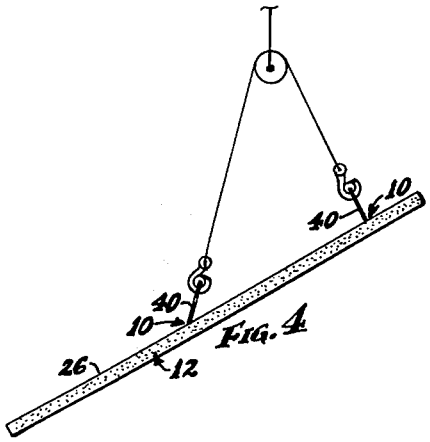
FIG. 4 is a pictorial sketch of a slab of concrete being handled by the use of two of the devices.
Figure 2:
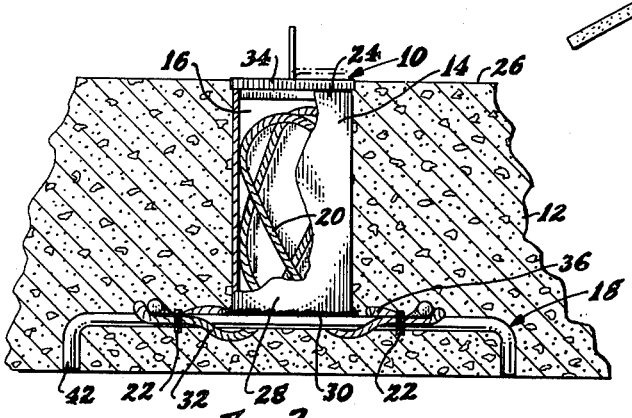
FIG. 2 is a side elevation view of the device embedded in a slab of concrete, the cable being shown in its retracted condition stuffed into the hollow core of the device.
Figure 3:
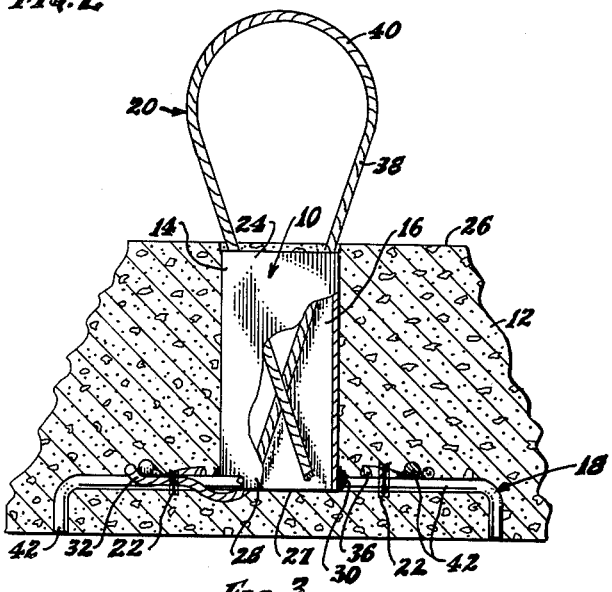
FIG. 3 is a view similar to FIG. 2, but with the cap removed and with the cable having been pulled out to its extended handle-providing position, and with certain portions broken away.
Figure 5:
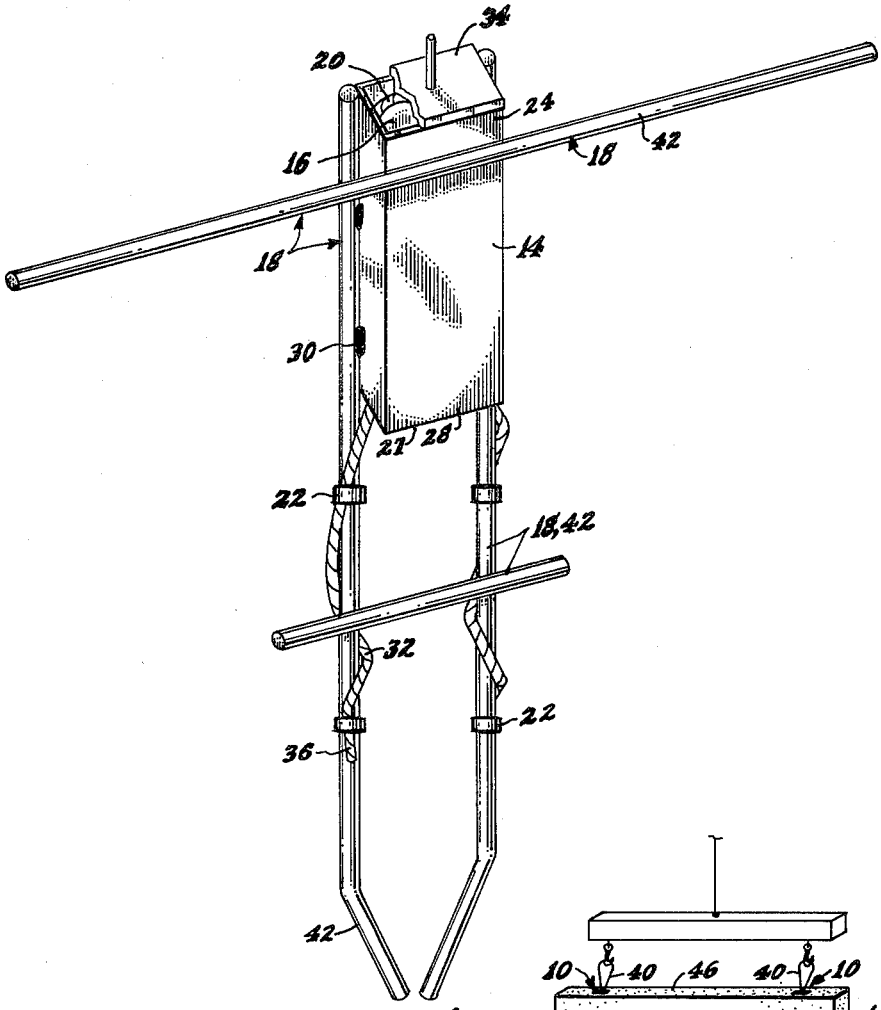
Figure 6:
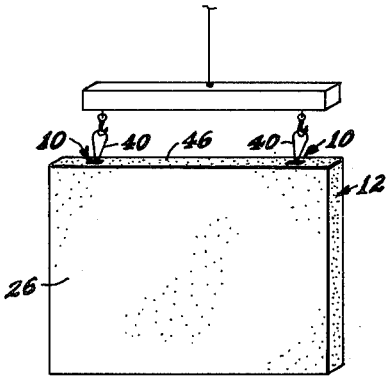
FIG. 6 is a pictorial sketch similar to FIG. 4, but illustrating a handling/lifting procedure with two of the devices embedded along an edge of the slab.

As shown in the drawings, the concepts of the present invention provide a new and advantageous handling/lifter device 10 for a bulky mass or slab 12 of associated material such concrete or the like. (Such material, as of course is well known, is of a nature such that its portions are relatively movable during an initial "wet" stage but then harden into a fixed and rigid bulky mass or slab in a subsequent "set up" or "cured" stage; and it is during the latter stage in which the mass or slab 12 of the heavy material is to be handled, lifted, or otherwise manipulated.)

The handling/lifter device 10 as shown has a housing body means 14; and it is to be particularly noted that the housing 14 provides an operatively-significantly large hollow chamber means 16 interiorly of the housing 14, the substantial size and nature of the hollow chamber 16 being explained further below.

Although some retention in the slab 12 may exist by the hold of the housing 14 in the slab, the form as shown shows retaining arm means 18 provided, which extend outwardly from the housing body 14 so as to be operatively engaged by the material of the slab 12 when in its operatively rigid stage for securely locking the device 10 into the mass or slab 12 of the concrete in a load-supporting nature or manner.

According to the inventive concepts of this invention, as shown the graspable component is provided by a cable means 20 having securing means 22 for securing the cable means 20 to the device 10. The securing means 22 for the cable 20 are not obstructive of the chamber 16 with respect to presence of the cable 20 when it is stuffed inside, as further discussed below.

Although the drawings are somewhat diagrammatic, it is to be noted that the cable 20 is of a length sufficiently long so as to provide a graspable component, that is, extendable above and graspable from above the outer end 24 of the housing body 14 which is the end adjacent the outer surface 26 of the slab 12.

The cable 20 is also to be noted as being sufficiently operatively flexible so as to permit the entirety of the cable 20 to be stuffed into the housing chamber 16 during the initial or pre-hardened stage of the concrete, and also again after any subsequent stage thereof; and this might occur, e.g., after the cable has been used for grasping in one or more previous handling or lifting or other manipulation of the bulky mass or a slab 12. However, when all handling of the slab 12 has been accomplished or finished, the cable 20 may be merely restuffed into the chamber 16, permanently, with but negligible cost of the "wasted" short length of cable material.

It will be noted that the housing body 14 is significantly long in relation to its cross-sectional shape and size, so as to provide that a substantial portion of the chamber 16 which is used for stuffing thereinto of the cable 20 is attributable to the axial depth of the chamber 16 (in contrast to its cross-sectional size and shape); and this minimizes the area of the concrete slab 12 which is to be subsequently covered (as by grouting) after finishing of all of the handling, lifting, or other manipulation steps.

Also, it should be noted that the relatively long length of the housing body 14 provides a mounting for the arm means 18 which is very substantially away from the outer surface 26 of the slab; and this assures minimal likelihood that an insufficient amount of the concrete or the like will be between the arm means 18 and the outer surface of the concrete or the like to achieve sufficient support strength.

The specific cross-sectional shape of the housing 14 is not critical to the operativity; but a desirable shape is the generally rectangular shape here shown.

In the initial securing of the cable means 20 it is caused to extend outwardly of the housing body 14 by emerging through a hole 27 in a portion 28 thereof substantially removed from the portion 24 adjacent the outer surface 26 of the concrete or the like. More particularly, the cable 20 is shown as passing downwardly, outwardly of the chamber 16 by passing through hole 27 in a lower chamber wall 28 to which the arm means 18 are connected to the device 10, as shown by welds 30.

In the form shown, the securing means 22 for the cable 20 operatively attaches the cable 20 to the assembly of arm means 18 and housing body 14 exteriorly of the chamber 16 of the housing 14; and tight retention of the cable 20 is further provided by causing the cable 20 to be formed to have at least one bend 32 around a portion of the arm means 18 thus to assist the securing means in the secure retention of the cable 20.

Desirably a cap member 34 is provided to cover the outer end 24 of the housing body 14 during the initial pouring stage of the concrete, keeping the wet concrete from getting into the cable chamber 16.

As indicated, the cable means 20 is provided in the form of a single length, both of whose ends 36 are secured to one or more portions of the assembly of housing body 14 and arm means 18, thereby providing that the intermediate portion 38 of that single length of cable 20 provides a graspable loop 40, without outer loops or other graspable components being needed to be provided for the cable 20.

It will further be noted that the housing body 14 is of such operatively small cross-sectional shape and size as to assure that the cable 20 is sufficiently supported, laterally with respect to the outer surface 26 of the slab 12, such that the cable 20, when moved to its outer position providing the loop 40 for being grasped in the manipulation of the mass or slab 12, maintains itself in a conveniently graspable erect condition outwardly of the outer surface of the mass or slab 12.

The arm means 18, it should be noted, may be of almost any form, and made even from non-uniform or irregular scrap stock; for once used, the entire device 10 remains embedded permanently within the slab 12.

Here the arm means 18 is shown as a welded assembly of rods or bars 42 welded to the housing body 14; but the nature of the arms is not critical except of course as to be of sufficient strength and enough lateral extent to provide the desired rivet-type locking sufficient to supplement the retention of the device 10 in the slab 12 merely by the locking effect on the housing 14 itself.

In the embodiment shown for installation at the edge 46 of the slab 12, all components may be the same as in the embodiment used out in the span of the slab 12, except merely that the pattern of arm means 18 is somewhat more critical and thus desirably of somewhat more shapely nature; for, in contrast to the need of the other embodiment to sustain a pull mostly merely perpendicular to the slab's surface 26, in the embodiment for installation at an edge 46 of the slab 12, the arms 18 must sustain lifting forces both perpendicular and along (or parallel to) the plane of the slab surface 26.

No bottom wall need be provided for the housing 14, for the viscosity of the wet concrete is sufficient, considering the relatively small cross-sectional area of the housing, that it has been found that the wet concrete does not significantly push up into the core 16 where it would interfere with the cable 20 stuffed therein.

Regardless of the specific nature of the arm means 18, the devices 10 are readily supported in the desired location with respect to the slab 12, and to its surface 26 or edge 46, by tack-welding (usually using some scrap strips of rod such as reinforcing bar stock) to the bed of reinforcing bars of the concrete.

It is thus seen that a handling/lifter device for heavy slabs as of concrete, according to the inventive concepts, provides a desired and advantageous device, yielding the high advantages of economy of construction and of the labor in the use of the device as an aid in the lifting or other handling of such heavy slabs, particularly considering the number of times a slab is to be handled.

Accordingly, it will thus be seen from the foregoing description of the invention according to this illustrative embodiment, considered with the accompanying drawings, that the present invention provides new and useful concepts of a handling/lifting device for heavy slabs, the devices yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown.

What is claimed is:

1. A handling/lifter device for a bulky mass or slab of associated material such as concrete or the like whose portions are relatively movable during an initial stage but are fixed into an operatively rigid bulky mass or slab in a subsequent stage during which the mass or slab of material is to be handled, lifted, or otherwise manipulated, the handling/lifter device comprising, in combination:

a housing body means which provides an operatively-significantly large hollow chamber means interiorly thereof;

arm means extending outwardly from the housing body means to be operatively engaged by the associated material when in its operatively rigid stage, in a device-locking manner in which the device is operatively locked into the mass or slab of the associated material in a load-supporting nature;

operatively flexible cable means;

securing means for securing the cable means to the device by means which are not obstructive of the chamber means with respect to presence of the cable means;

the cable means being of a length sufficiently long so as to provide a graspable component, graspable from above the outer end of the housing body means; and the cable means also being sufficiently operatively flexible so as to permit the entirety thereof to be stuffed into the chamber means during the initial stage of the associated material and again after any subsequent stage thereof after the cable means has been grasped in a handling or lifting or other manipulation of the bulky mass or slab.

2. The invention as set forth in claim 1, in which the housing body means is significantly long in relation to its cross-sectional shape and size so as to provide that a substantial portion of the chamber means which is used for stuffing thereinto of the cable means is attributable to the axial depth of the chamber means in contrast to its cross-sectional size and shape, thus minimizing the area of the bulky mass or slab of associated material which is to be subsequently covered after the handling, lifting, or other manipulation is accomplished.

3. The invention as set forth in either claim 1 or 2, in which the housing body means is of a long length, thereby providing a mounting for the arm means which is very substantially away from the outer surface of the bulky mass or slab, thus assuring minimal likelihood that an insufficient amount of the concrete or the like will be supportively present between the arm means and the outer surface of the concrete or the like.

4. The invention as set forth in claim 1 in which the housing body means is of generally rectangular form.

5. The invention as set forth in claim 1 in which the cable means extends outwardly of the housing body means by emerging through a portion thereof substantially removed from the portion adjacent the outer surface of the concrete or the like.

6. The invention as set forth in claim 5 in which the securing means for the cable means operatively attaches the cable means to the assembly of arm means and housing body means exteriorly of the chamber means.

7. The invention as set forth in claim 6, in which the cable means is caused to be formed to have at least one bend around a portion of the arm means thus to assist the securing means in the secure retention of the cable means.

8. The invention as set forth in claim 1 in which the housing body means is of such operatively small cross-sectional shape and size as to assure that the cable means is sufficiently supported, laterally with respect to the outer surface of the bulky mass or slab, such that the cable means, when moved to its outer position for being grasped in the manipulation of the mass or slab, maintains itself in a conveniently graspable erect condition outwardly of said outer surface of the mass or slab.

* * * * *

UNITED STATES PATENT AND TRADEMARK OFFICE

CERTIFICATE OF CORRECTION

PATENT NO. : 4,304,431

DATED : December 8, 1981

INVENTOR(S) : Everett V. Walston

It is certified that error appears in the above—identified patent and that said Letters Patent is hereby corrected as shown below:

Col. 4, line 62: The word "outer" should be:
-- other -- .

Signed and Sealed this

*Twentieth* Day of *April 1982*

[SEAL]

*Attest:*

GERALD J. MOSSINGHOFF

*Attesting Officer*

*Commissioner of Patents and Trademarks*